US006443321B1

(12) United States Patent
Felsenthal

(10) Patent No.: US 6,443,321 B1
(45) Date of Patent: Sep. 3, 2002

(54) LUGGAGE RACK WITH HANGING BAR FOR GARMENTS

(76) Inventor: Sandy Alan Felsenthal, 5428 Collingwood Cove, Memphis, TN (US) 38120

( * ) Notice: Subject to any disclaimer, the term of this patent is extended or adjusted under 35 U.S.C. 154(b) by 0 days.

(21) Appl. No.: 09/833,597

(22) Filed: Apr. 12, 2001

(51) Int. Cl.[7] ..... A47B 47/00
(52) U.S. Cl. ..... 211/195; 248/164
(58) Field of Search ..... 211/13.1, 195, 211/85.3, 200, 201, 189, 182; 190/18 R; D6/462–468, 397, 343, 409–415, 458, 477, 475, 455–456, 546; 248/164–166, 169, 440.1

(56) References Cited

U.S. PATENT DOCUMENTS

| | | | | | |
|---|---|---|---|---|---|
| 894,561 | A | | 7/1908 | Wood | |
| 1,196,207 | A | | 8/1916 | Cane | |
| 1,685,925 | A | | 10/1928 | Linck et al. | |
| 2,415,784 | A | * | 2/1947 | Block | 211/201 |
| D164,500 | S | * | 9/1951 | Ives | D6/462 |
| 2,939,584 | A | * | 6/1960 | Bergman, Jr. | 248/166 |
| 3,033,379 | A | | 5/1962 | Clark | |
| D195,564 | S | * | 7/1963 | Gleitsman et al. | D6/463 |
| D195,565 | S | * | 7/1963 | Gleitsman et al. | D6/463 |
| 3,168,329 | A | * | 2/1965 | Goldschmidt | 190/18 R |
| 3,189,380 | A | | 6/1965 | Reguitti | |
| 4,029,318 | A | * | 6/1977 | Boss | 248/164 |
| D278,769 | S | * | 5/1985 | Sharpe | D6/414 |
| 4,792,071 | A | * | 12/1988 | Scarpa et al. | 223/68 |
| D306,103 | S | * | 2/1990 | Arnold | D6/396 |
| D317,686 | S | * | 6/1991 | Kee | D6/410 |
| 5,029,740 | A | * | 7/1991 | Cox | 224/42.01 |
| D329,903 | S | * | 9/1992 | Craig | D6/462 |
| 5,146,635 | A | * | 9/1992 | Gastle et al. | 248/164 |
| 5,190,254 | A | * | 3/1993 | Maguire | 248/164 |
| 5,190,305 | A | * | 3/1993 | Putman | 280/79.3 |
| 5,213,221 | A | * | 5/1993 | Raye, Sr. | 211/195 |
| D340,149 | S | * | 10/1993 | Granoff | D6/411 |
| D357,827 | S | * | 5/1995 | Schultz | D6/462 |
| D364,516 | S | * | 11/1995 | Helenowski | D6/410 |
| 5,865,517 | A | * | 2/1999 | Wang | 211/204 |
| 5,913,270 | A | * | 6/1999 | Price | 211/201 |
| 6,073,783 | A | | 6/2000 | Allman | |
| D436,677 | S | * | 1/2001 | Walker | D6/458 |
| 6,224,072 | B1 | * | 5/2001 | Weck et al. | 211/204 |
| 6,308,837 | B1 | * | 10/2001 | Bragg et al. | 211/13.1 |
| D450,947 | S | * | 11/2001 | Walker | D6/410 |

* cited by examiner

*Primary Examiner*—Daniel P. Stodola
*Assistant Examiner*—Jennifer E. Novosad
(74) *Attorney, Agent, or Firm*—Peter J. Georges; William D. Breneman; Breneman & Georges

(57) ABSTRACT

A storage unit has a lower flexible rack configured to hold resiliently at least one piece of luggage and an upper horseshoe-shaped hanging bar configured to suspend clothes therefrom. A removable, horizontally oriented, stabilizing bar is secured at a junction above the lower flexible rack but below the upper horseshoe-shaped hanging bar. The storage unit also includes a pair of replaceable, vertically extending tubes connected to the lower flexible rack and a pair of inverted L-shaped tubes connected to the upper horseshoe-shaped hanging bar. The pair of replaceable, vertically extending tubes and the pair of inverted L-shaped tubes are connected to each other. Also, the pair of vertically extending tubes is replaceable by another pair of vertically extending tubes of a different length.

2 Claims, 3 Drawing Sheets

36D
36E
14B
40
36C
14A
36
14
22
16
38B
36A
38A
36B
14A
44
40

36E
34C
34D
44
42
36C
34
32
26B
30
42
34B
34A
26C
18L
18K
28
28B
22A
36
18I
22B
38A
18H
18G
36A
36B
18J
18F
24
22
18
34C
46
38B
34
26A
18
16
34D
34A
26B
34B
18E
12
18I
26C
18L
18K
28B
16
10
28
18E
20
32
18J
30
24
16
18H
19A
22B
20
26A
18G
18D
22
19C
22A
18F 18C
19B
18
18
18E
18E
20
20

LUGGAGE RACK WITH HANGING BAR FOR GARMENTS

BACKGROUND OF THE INVENTION

1. Field of the Invention

The present invention relates to collapsible racks and more particularly to a foldable luggage rack having a support bar for hanging garments.

2. Description of the Related Art

Many luggage racks are on the market and have been available sine the early part of the $20^{th}$ century. For instance, U.S. Pat. No. 894,561 issued to Charles L. Wood on Jul. 28, 1908, for a wooden article of furniture designed particularly for use in hotels for supporting garments and for providing an inflexible seat for a satchel, dress-suit case, or the like.

Later, U.S. Pat. No. 1,196,207 issued to Salvatore Cane on Aug. 29, 1916, for a dismountable wooden chair having parts which could be separated easily and disassembled into a conveniently portable package.

U.S. Pat. No. 1,685,925 issued to Joseph Linck et al. On Oct. 2, 1928, for a collapsible wooden rack for use in homes, restaurants, and places of entertainment where a temporary device for the hanging of outdoor garments, such as coats and hats, was desirable.

U.S. Pat. No. 3,033,379 issued to Alvin F. Clark on May 8, 1962, for a drying rack adapted for supporting wet clothing articles and for collecting water which drips from the articles over the course of time.

U.S. Pat. No. 3,189,380 issued to Aristide Reguitti on Jun. 15, 1965, for a folding wooden seat which is adapted to be employed for supporting articles of clothing and for storing small personal items within the seat.

At the turn of this century, U.S. Pat. No. 6,073,783 issued to Michael X. Allman on Jun. 13, 2000, for a wooden drying rack for athletic equipment. The rack adjusts to a compact shape for storage and/or transport purposes.

However, all of these racks are heavy, bulky, complicated, expensive, and hard to use. Therefore, it remains a problem in the field to provide a lightweight, flexible, simple, inexpensive and easy to operate collapsible rack with a support bar for hanging garments.

SUMMARY OF THE INVENTION

It is a primary object of the present invention to provide a lightweight, flexible, simple, inexpensive and easy to operate collapsible rack with a support bar for the storage of hanging garments in additional open space in a room, other than a closet.

It is a secondary object of the present invention to provide a lightweight metal rack with a flexible seat for a piece of luggage, such as a suitcase, and also with a height-adjustable bar for inexpensively and easily hanging clothes, such as suits and coats, near to the rack so that the user does not forget anything when leaving the room, whether in a private home, hotel, motel, dormitory, or the like.

It is a tertiary object of the present invention to provide a stabilizing horizontal bar which connects vertical steel tubes that extend and support the hanging bar. Both bars are situated just above the rack for the piece of luggage. Thus, the garments are hung in very close proximity to the luggage so that nothing is overlooked when leaving the room.

It is a further object of the present invention to provide pairs of extendable steel tubes to reach the height necessary for the hanging bar to hold clothing of different lengths.

It is an additional object of the present invention to provide the hanging bar so that it extends forwardly over the luggage rack in order to stabilize the unit while hanging clothing thereon.

These and other objects of the present invention will become readily apparent while studying a preferred embodiment discussed in the following detailed description and shown in the accompanying drawings which are described below.

DETAILED DESCRIPTION OF THE INVENTION

Figures 1, 2:
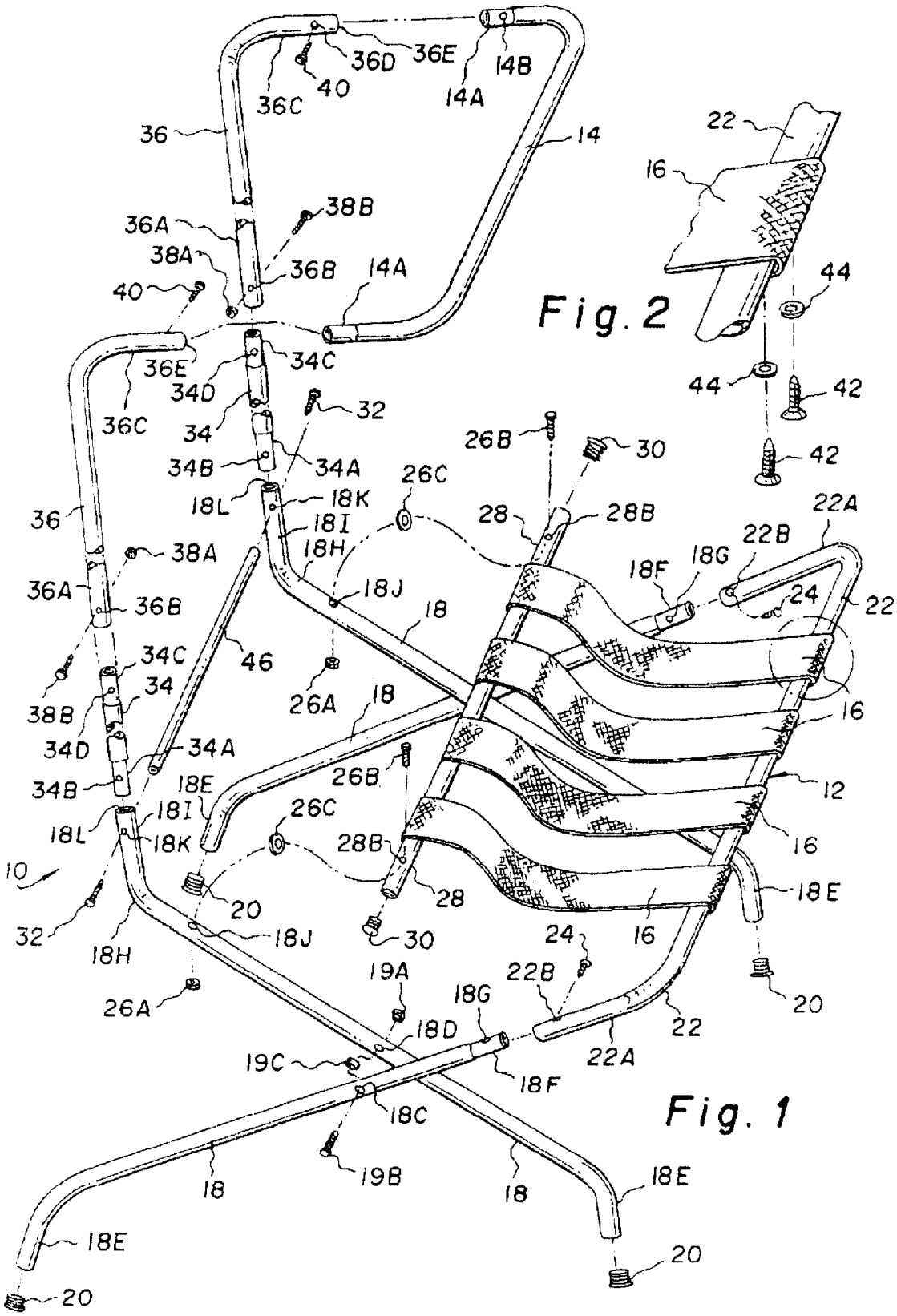
FIG. 1 is an exploded perspective view of the preferred embodiment of the present invention.
FIG. 2 is a detailed view of the area encircled in FIG. 1.

With reference to FIG. 1 of the drawings, there is illustrated a storage unit 10 having a lower flexible rack 12 and an upper horseshoe-shaped hanging bar 14 for suspending clothes therefrom. The entire storage unit 10 is made of lightweight hollow metal tubes, except for a seat portion which is made of a plurality of flexible fabric or plastic strips 16 spaced apart from each other for resiliently holding at least one piece of luggage, such as a suitcase, thereon. Alternatively, the strips 16 may be replaced by a single flexible cloth seat.

Two pairs of crossing tubes 18 are secured together near their midsection by a nut 19A, a bolt 19B and an intermediate washer 19C. The bolt 19B passes through a hole 18D bored completely through both tubes 18. Feet 20 are threaded into bent bottom ends 18E of both tubes 18.

One pair of crossing tubes 18 is inclined forwardly and is connected together at their upper narrowed ends 18F by a generally horseshoe-shaped front seat tube 22. Bent ends 22A of the front seat tube 22 have holes 22B bored through one side thereof. These bent ends 22A slide over the upper narrowed ends 18F of the crossing tubes 18. Each bent end 22A receives a screw 24 that is also threaded through a hole 18G bored into one side of each upper narrowed end 18F.

Another pair of crossing tubes 18 is inclined rearwardly and each has a bend 18H that forms a vertically oriented top end 18I. Below the bend 18H, each rearwardly inclined tube 18 has a hole 18J bored completely therethrough for receiving a bolt 26B secured by a nut 26A. A washer 26C spaces each rearwardly inclined tube 18 from a horizontally oriented rear seat tube 28. This single rear seat tube 28 has holes 28B bored completely therethrough near to each end which is closed by a threaded plug 30.

Above the bend 18H, each vertically oriented top end 18I has a hole 18K bored completely therethrough for receiving a screw 32 that passes therethrough into opposite ends of a removable stabilizing bar 46 which is horizontally oriented.

Into an upper opening 18L in each top end 18I, there is secured, by the screw 32, a vertically extending tube 34 shown in broken lines at its midsection. Each tube 34 has a lower narrowed sleeve 34A with a hole 34B bored completely therethrough for receiving the screw 32.

The extending tubes 34 are made in pairs of equal length that may be different and varied by each manufacturer so that the overall height of the storage unit 10 may be adjustable. Placing the tubes 34 into the upper openings 18L of the rearwardly inclined crossing tubes 18 necessarily increases the overall height of the storage unit 10 while replacing one pair of longer tubes 34 with another pair of shorter tubes 34 necessarily decreases the overall height of the storage unit 10. The consumer may choose to use either the longer or the shorter pair of extending tubes 34 supplied by the manufacturer, depending upon whether the length of the clothes to be hung on the hanging bar 14 are relatively long or short, respectively.

Each tube 34 also has an upper narrowed sleeve 34C that is slipped into a lower end 36A of an inverted L-shaped tube 36. Each lower end 36A has a hole 36B bored completely therethrough for receiving a bolt 38B which is secured by a nut 38A.

In an alternative embodiment not shown, each extending tube 34 may have a relatively long sleeve 34C so that the sleeve 34C may be inserted far up into the lower end 36A of the L-shaped tube 36, thus making the nut 38A, the bolt 38B, and the holes 36B and 34D unnecessary. Although this alternative embodiment is less expensive to manufacture, it is presently not preferred because each L-shaped tube 36 is not tightly secured onto each extending tube 34.

At short upper ends 36C of each L-shaped tube 36, there is a threaded hole 36D formed in a side thereof for receiving a screw 40 that also passes through a hole 14B bored into only an internal side of each narrowed sleeve 14A which is slipped into a top opening 36E in each L-shaped tube 36.

In FIG. 2, one end of one strip 16 of flexible fabric or plastic is wrapped around the horseshoe-shaped tube 22 and is secured thereto by a pair of screws 42 spaced therefrom by a pair of washers 44.

Returning to FIG. 1, an opposite end of each strip 16 is likewise wrapped around the rear seat tube 28 and is secured thereto by another pair of screws and washers (not shown).

Figure 3:
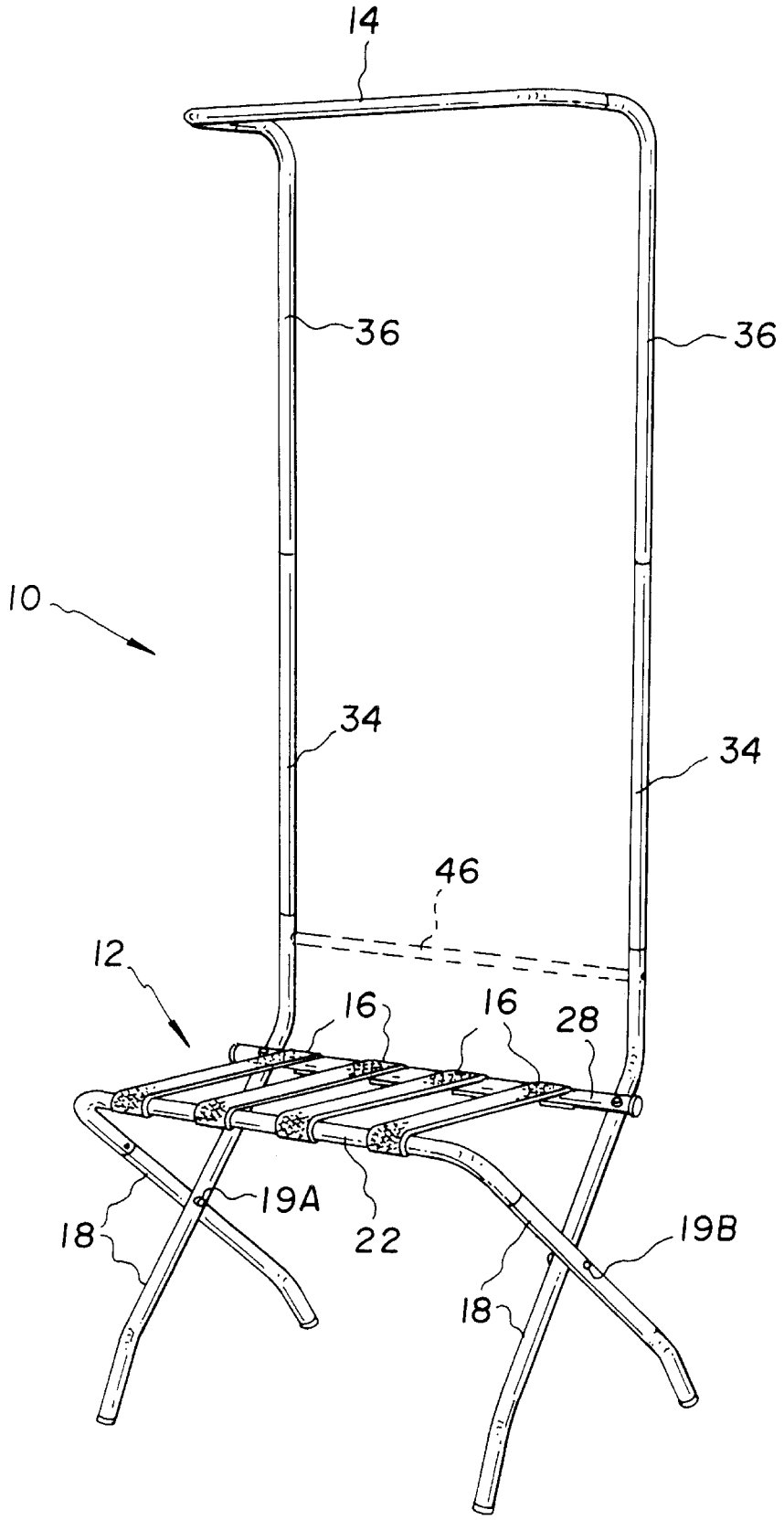
FIG. 3 is a perspective view of the preferred embodiment in its assembled condition.

In FIG. 3, the storage unit 10 is shown in its assembled condition with its lower flexible rack 12 and its upper hanging bar 14. The strips 16 are secured at the one end to the horseshoe-shaped tube 22 and at the opposite end to the rear seat tube 28.

The two pairs of crossing tubes 18 are secured together at their midsections by the bolts 19B and the nuts 19A. The pair of rearwardly inclined crossing tubes 18 retain the removable, horizontally oriented stabilizing bar 46 which is not needed when only the seat portion 12 of the storage unit 10 is being used, i.e., when the hanging bar 14, the L-shaped tubes 36 and the extending tubes 34 are removed from the storage unit 10 because no clothes are being hung from the hanging bar 14.

Figure 4:
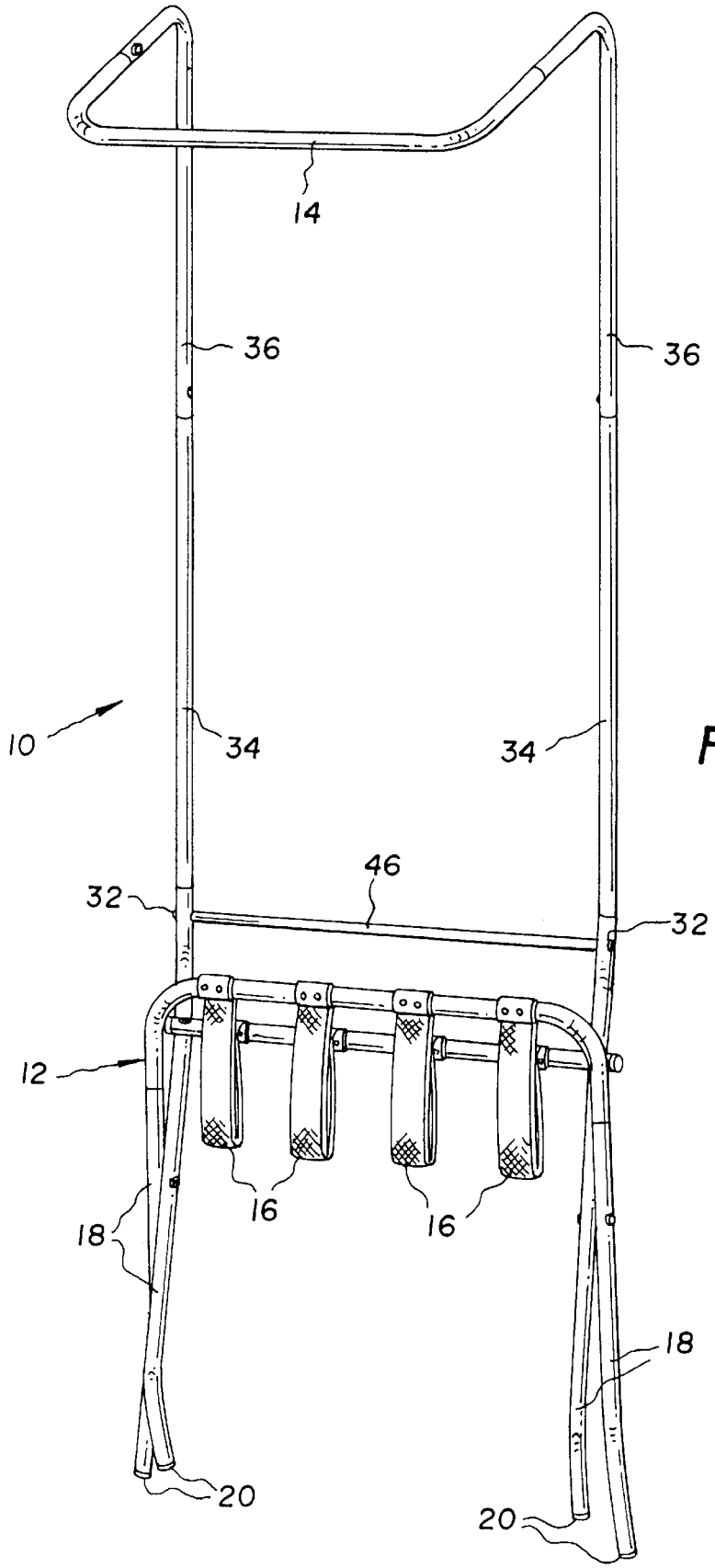
FIG. 4 is a perspective view of the preferred embodiment in its folded condition.

As seen in FIG. 4, the storage unit 10 is shown in its folded condition for leaning against a wall or the like. Although the seat portion 12, with its fabric strips 16, is not being used, the hanging bar 14 remains usable for a light amount of clothing. However, it is not recommended to use the storage unit 10 in this folded condition because its height makes the unit 10 unstable when the feet 20 on the crossing tubes 18 are close together.

If no clothes are being hung on the hanging bar 14, it is also recommended, but not required, that the user disconnect the extending tubes 34 by removing the screws 32 from the rearwardly inclined crossing tubes 18 at their junction above the stabilizing bar 46. Thus, the extending tubes 34, the L-shaped tubes 36, and the hanging bar 14 may be stored separately from the lower rack 12 of the storage unit 10.

Numerous modifications and variations of the present invention are possible in light of the above teachings. Therefore, it is to be understood that, within the scope of the appended claims, the invention may be considered to have a reasonable range of equivalents and may be made otherwise than as the preferred embodiment is specifically described herein.

What is claimed as the invention is:

1. A storage unit comprising:

a lower flexible rack configured to hold at least one piece of luggage resiliently;

wherein said lower flexible rack includes a pair of forwardly inclined crossing tubes and a pair of rearwardly inclined crossing tubes;

a removable, horizontally oriented stabilizing bar configured to connect together top ends of the pair of rearwardly inclined crossing tubes;

an upper horseshoe-shaped hanging bar configured to suspend clothes therefrom;

a pair of removable, vertically extending tubes connected to the top ends of the pair of rearwardly inclined crossing tubes; and a pair of inverted L-shaped tubes connected to the upper horseshoe-shaped hanging bar;

wherein said pair of removable, vertically extending tubes and said pair of inverted L-shaped tubes are connected to each other.

2. A storage unit comprising:

a lower flexible rack configured to hold at least one piece of luggage resiliently;

wherein said lower flexible rack includes a pair of forwardly inclined crossing tubes and a pair of rearwardly inclined crossing tubes;

a removable, horizontally oriented stabilizing bar configured to connect together top ends of the pair of rearwardly inclined crossing tubes; and an upper horseshoe-shaped hanging bar configured to suspend clothes therefrom;

wherein said lower flexible rack further includes:

a plurality of flexible strips spaced apart from each other;

a horseshoe-shaped front seat tube configured to connect together upper ends of the pair of forwardly inclined crossing tubes and also configured to have wrapped therearound one end of each of the plurality of flexible strips; and a rear seat tube configured to connect together the pair of rearwardly inclined crossing tubes and also configured to have wrapped therearound an opposite end of each of the plurality of flexible strips.

* * * * *